US007959537B2

(12) United States Patent
Sugiura et al.

(10) Patent No.: US 7,959,537 B2
(45) Date of Patent: Jun. 14, 2011

(54) VALVE TIMING CONTROL APPARATUS

(75) Inventors: Taei Sugiura, Anjo (JP); Yasushi Morii, Nagoya (JP)

(73) Assignee: Denso Corporation, Kariya (JP)

( * ) Notice: Subject to any disclaimer, the term of this patent is extended or adjusted under 35 U.S.C. 154(b) by 603 days.

(21) Appl. No.: 12/139,056

(22) Filed: Jun. 13, 2008

(65) Prior Publication Data

US 2009/0017952 A1 Jan. 15, 2009

(30) Foreign Application Priority Data

Jul. 9, 2007 (JP) ..... 2007-180165

(51) Int. Cl.
*F16H 1/32* (2006.01)
*F01L 1/34* (2006.01)

(52) U.S. Cl. ..... 477/176; 123/90.15

(58) Field of Classification Search ..... 475/176; 123/90.15

See application file for complete search history.

(56) References Cited

U.S. PATENT DOCUMENTS 6,848,401 B2 * 2/2005 Takenaka et al. ..... 123/90.15
7,281,507 B2 * 10/2007 Uehama et al. ..... 123/90.17
7,314,030 B2 * 1/2008 Uehama et al. ..... 123/90.17
7,377,242 B2 * 5/2008 Uehama et al. ..... 123/90.17
7,578,271 B2 * 8/2009 Sugiura et al. ..... 123/90.15
7,603,975 B2 * 10/2009 Sugiura et al. ..... 123/90.17
7,621,243 B2 * 11/2009 Sugiura et al. ..... 123/90.17
7,669,568 B2 * 3/2010 Sugiura et al. ..... 123/90.17
2007/0163526 A1 7/2007 Sugiura et al.

FOREIGN PATENT DOCUMENTS

DE 41 10 195 10/1992

OTHER PUBLICATIONS

U.S. Appl. No. 11/645,621, Taei Sugiura et al., filed Dec. 27, 2006, (JP 2006-7361; JP 2006-193774; and JP 2006-240365).

* cited by examiner

*Primary Examiner* — Dirk Wright
(74) *Attorney, Agent, or Firm* — Nixon & Vanderhye PC

(57) ABSTRACT

A first rotary member rotates with a crankshaft and has a first gear. A second rotary member rotates with a camshaft and has a second gear that is axially shifted from the first gear. A planetary rotary member has third and fourth gears, which are eccentrically meshed respectively with the first and second gears to perform a planetary motion. A biasing member is interposed between the planetary rotary member and a planetary carrier, which supports the planetary rotary member. The planetary rotary member is in contact with the biasing member at a contact portion having an axial center. The axial center is located on a radially inner side of a meshed portion between the second and fourth gears, which has a backlash larger than that of a meshed portion between the first and third gears.

21 Claims, 12 Drawing Sheets

VALVE TIMING CONTROL APPARATUS

CROSS REFERENCE TO RELATED APPLICATIONS

This application is based on and incorporates herein by reference Japanese Patent Application No. 2007-180165 filed on Jul. 9, 2007.

FIELD OF THE INVENTION

The present invention relates to a valve timing control apparatus for an internal combustion engine.

BACKGROUND OF THE INVENTION

According to DE4110195A1, a valve timing control apparatus includes a rotary member, which is rotated in conjunction with a crankshaft, and a rotary member, which is rotated in conjunction with a camshaft. The rotary members are connected by a planetary gear mechanism so as to control a valve timing on the basis of the relative phase between the rotary members.

A valve timing control apparatus having such a structure includes first to fourth gear portions. The third gear portion and the fourth gear portion are unitarily provided with a planetary rotary member. The third and fourth gear portions are eccentrically meshed respectively with the first gear portion, which is provided in the interlocking rotary member of the crankshaft, and the second gear portion, which is provided in the interlocking rotary member of the camshaft. Thus, a large reduction ratio can be attained with a compact structure, so that the valve timing control apparatus can be suitably mounted in an internal combustion engine.

In the above valve timing control apparatus, backlash ascribable to a manufacturing tolerance or the like inevitably exist at the meshed portion between the first gear portion and the third gear portion and the meshed portion between the second gear portion and the fourth gear portion. Such a backlash may cause an abnormal sound or damage ascribable to the collision between the gear portions. Accordingly, the backlash is preferably eliminated. However, the third gear portion and the fourth gear portion are unitarily provided in the planetary rotary member. Accordingly, it has been difficult to simultaneously eliminate the backlash at both the meshed portion between the first gear portion and the third gear portion and the meshed portion between the second gear portion and the fourth gear portion.

SUMMARY OF THE INVENTION

In view of the foregoing and other problems, it is an object of the present invention to produce a valve timing control apparatus being capable of reducing abnormal sound and damage therein.

According to one aspect of the present invention, a valve timing control apparatus configured to be transmitted with torque from a crankshaft and controlling a camshaft to manipulate a valve timing of at least one of an intake valve and an exhaust valve of an internal combustion engine, the valve timing control apparatus comprises a first rotary member configured to rotate in conjunction with the crankshaft and having a first gear portion. The valve timing control apparatus further comprises a second rotary member configured to rotate in conjunction with the camshaft and having a second gear portion that is shifted from the first gear portion with respect to an axial direction. The valve timing control apparatus further comprises a planetary rotary member having a third gear portion and a fourth gear portion, which are configured to be eccentrically meshed respectively with the first gear portion and the second gear portion so as to unitarily perform a planetary motion thereby to change a relative phase between the first rotary member and the second rotary member. The valve timing control apparatus further comprises a planetary carrier configured to support the planetary rotary member from a radially inner side. The valve timing control apparatus further comprises a biasing member interposed between the planetary rotary member and the planetary carrier to bias the planetary rotary member radially outward. The first gear portion and the third gear portion therebetween define a first-third meshed portion. The second gear portion and the fourth gear portion therebetween define a second-fourth meshed portion.

According to one aspect of the present invention, the second-fourth meshed portion has a backlash, which is larger than a backlash of the first-third meshed portion. The planetary rotary member is in contact with the biasing member at a contact portion having a center position with respect to the axial direction. The center position is located on a radially inner side of the second-fourth meshed portion.

According to another aspect of the present invention, the first-third meshed portion has a backlash, which is larger than a backlash of the second-fourth meshed portion. The planetary rotary member is in contact with the biasing member at a contact portion having a center position with respect to the axial direction. The center position is located on a radially inner side of the first-third meshed portion.

According to another aspect of the present invention, the planetary rotary member is in contact with the biasing member at a contact portion having a center position with respect to the axial direction. The center position is located between the first-third meshed portion and the second-fourth meshed portion with respect to an axial direction of the planetary rotary member.

According to another aspect of the present invention, the center position is located on a radially inner side of one of the first-third meshed portion and the second gear portion, which has a backlash larger than a backlash of an other of the first-third meshed portion and the second gear portion.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
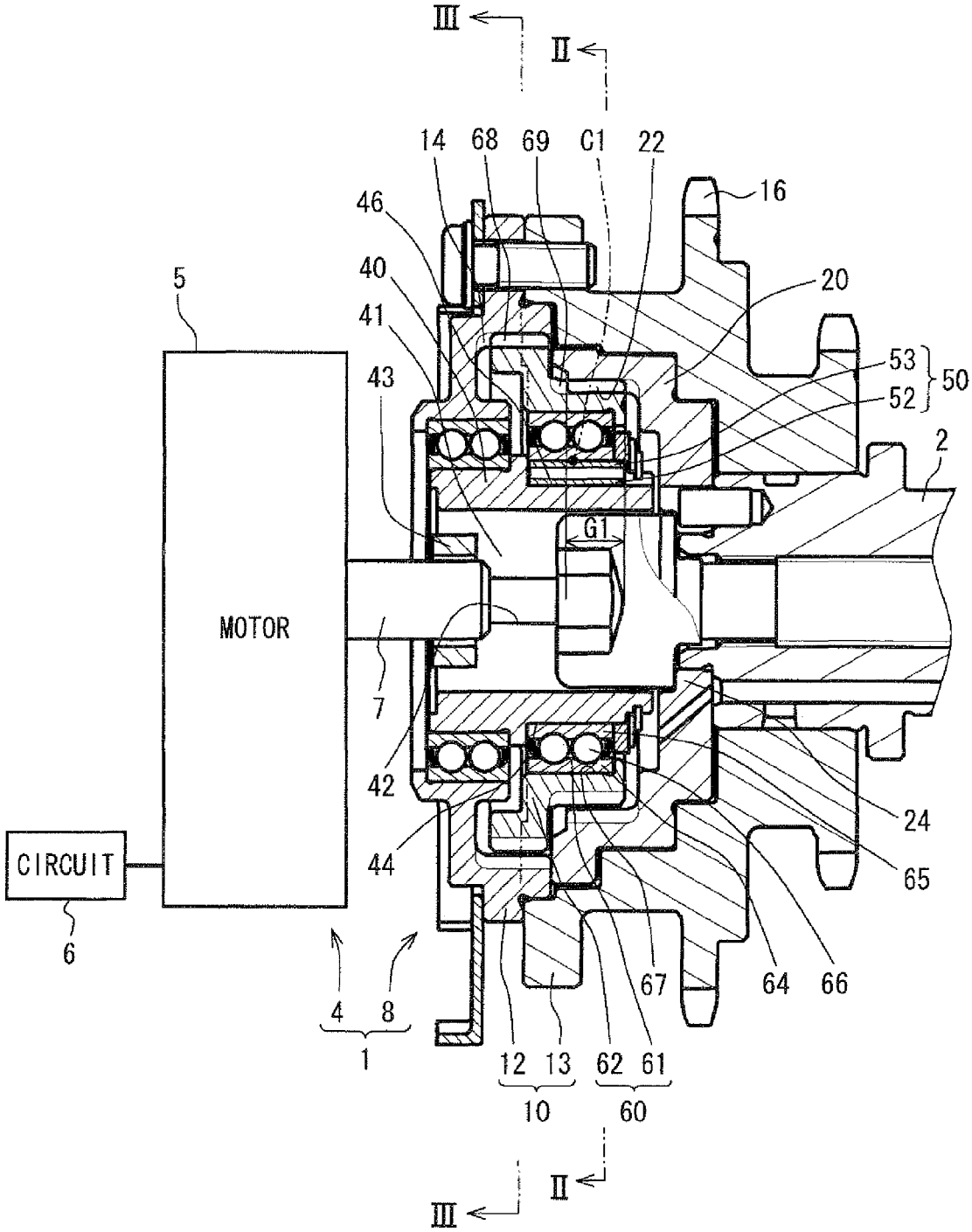
FIG. 1 is a sectional view showing a valve timing control apparatus according to a first embodiment.

A valve timing control apparatus 1 according to the present first embodiment is described with reference to FIG. 1. FIG. 1 is a sectional view taken along the line I-I in FIG. 2. The valve timing control apparatus 1 is mounted on a vehicle, and it is provided in a transmission system, which transmits an engine torque from a crankshaft (not shown) of an internal combustion engine to a camshaft 2. The valve timing control apparatus 1 is set up by combining a torque generation system 4, a phase control mechanism 8, and the like. This valve timing control apparatus 1 controls the phase (engine phase) of the camshaft 2 relative to the crankshaft, thereby to sequentially perform a valve timing control for the internal combustion engine. In the present embodiment, the camshaft 2 opens and closes the intake valve (not shown) of the internal combustion engine. The valve timing control apparatus 1 controls the valve timing of the intake valve.

First, the torque generation system 4 is explained. This torque generation system 4 includes an electric motor 5 and an energization control circuit 6.

The motor 5 is, for example, a brushless motor, and generates a control torque to be transmitted to a rotary shaft 7, when being energized. The energization control circuit 6 is configured of, for example, a microcomputer and a motor driver. The energization control circuit 6 is arranged outside and/or inside the motor 5. The energization control circuit 6 is electrically connected with the motor 5 to control the energization for the motor 5 in accordance with the operating condition of the internal combustion engine. The motor 5 controls to hold, increase, or decrease the control torque in accordance with the controlled energization. The control torque is transmitted to the rotary shaft 7.

Next, the phase control mechanism 8 will be explained. The phase control mechanism 8 includes a driving side rotary member 10, a driven side rotary member 20, a planetary carrier 40, an resilient member 50, and a planetary rotary member 60.

The driving side rotary member 10 is so configured that a toothed wheel member 12 and a sprocket 13, both of which are formed in the shape of bottomed cylinders, are coaxially secured with screws. The peripheral wall portion of the toothed wheel member 12 forms a driving side internal gear portion 14 having the addendum circle, which lies on the radially inner side of the deddendum circle of the driving side internal gear portion 14. The sprocket 13 is provided with multiple teeth 16, which protrude radially outward. An annular timing chain (not shown) is extended over between the teeth 16 and the teeth of the crankshaft, whereby the sprocket 13 is connected with the crankshaft. Accordingly, when the engine torque outputted from the crankshaft is inputted to the sprocket 13 through the timing chain, the driving side rotary member 10 rotates while holding a relative phase to the crankshaft, in conjunction with the crankshaft. On this occasion, the rotating direction of the driving side rotary member 10 is counterclockwise in FIGS. 2, 3.

Figure 2:
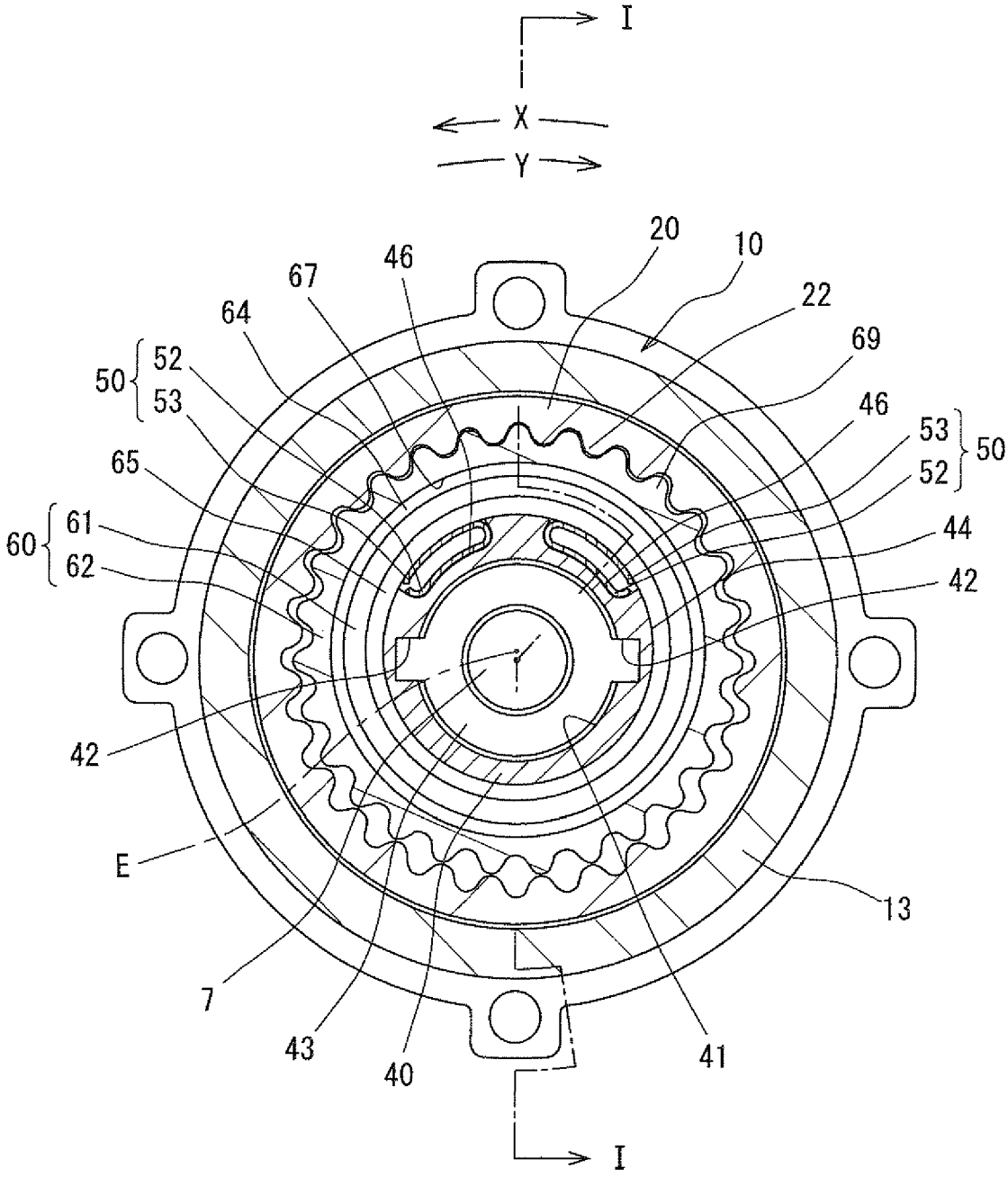
FIG. 2 is a sectional view taken along the line II-II in FIG. 1.

As shown in FIGS. 1, 2, the driven side rotary member 20, which is formed in the shape of a bottomed cylinder, is snugly fitted with the inner peripheral side of the sprocket 13. The peripheral wall portion of the driven side rotary member 20 forms a driven side internal gear portion 22 having the addendum circle, which lies on the radially inner side of the deddendum circle of the driven side internal gear portion 22. The driven side internal gear portion 22 is arranged in a manner to be coaxial with the driving side internal gear portion 14 and to be shifted in the axial direction relative to the driving side internal gear portion 14. The diameter of the driven side internal gear portion 22 is smaller than that of the driving side internal gear portion 14. The number of teeth of the driven side internal gear portion 22 is smaller than the number of teeth of the driving side internal gear portion 14.

As shown in FIG. 1, the bottom wall portion of the driven side rotary member 20 forms a connecting portion 24, which is coaxially connected to the camshaft 2. In the present structure, the driven side rotary member 20 is rotatable in conjunction with the camshaft 2 while holding a relative phase to the camshaft 2, and the driven side rotary member 20 is relatively rotatable to the driving side rotary member 10. The driven side rotary member 20 advances with respect to the driving side rotary member 10 in a relatively rotating direction X in FIGS. 2, 3. The driven side rotary member 20 retards with respect to the driving side rotary member 10 in a relatively rotating direction Y in FIGS. 2, 3.

Figure 3:
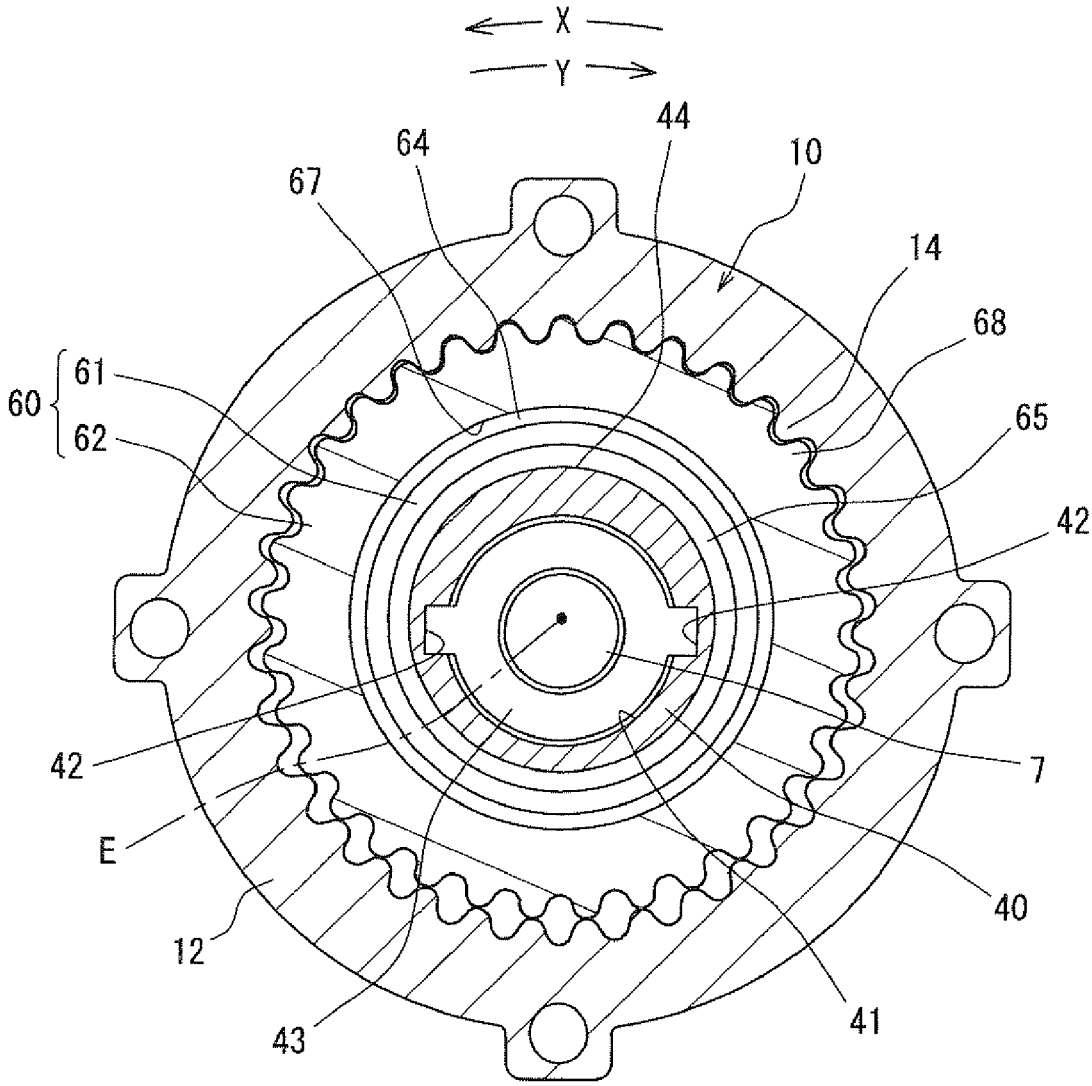
FIG. 3 is a sectional view taken along the line III-III in FIG. 1.

As shown in FIGS. 1 to 3, the planetary carrier 40, which is formed in the shape of a cylinder, has an inner peripheral portion defining an input portion 41 to which the control torque is inputted from the rotary shaft 7 of the torque generation system 4. The input portion 41 has multiple grooves 42, which open radially inward. The grooves 42 are arranged concentrically with the gear portions 14 and 22 and the rotary shaft 7. The planetary carrier 40 is connected with the rotary shaft 7 via a joint 43, which is snugly fitted in the grooves 42. In the present connection, the planetary carrier 40 is rotatable unitarily with the rotary shaft 7, and the planetary carrier 40 is relatively rotatable to the rotary members 10 and 20.

The planetary carrier 40 has the outer peripheral portion defining an eccentric portion 44, which is eccentric to the gear portions 14 and 22. The eccentric portion 44 has a pair of recesses 46 which are open radially outward. In addition, the resilient member 50 is accommodated in each of the recesses 46.

The planetary rotary member 60 is constructed by combining a planetary bearing 61 and a planetary gear 62. The planetary bearing 61 is a radial bearing in which ball-like rollers 66 are retained between an outer ring 64 and an inner ring 65. The outer ring 64 is concentrically press-fitted onto the inner peripheral side of the center hole 67 of the planetary gear 62. On the other hand, the inner ring 65 is concentrically fitted onto the outer peripheral side of the eccentric portion 44 of the planetary carrier 40. In the present structure, the planetary bearing 61 is supported by the planetary carrier 40 from the inner peripheral side of the planetary bearing 61, and the planetary bearing 61 exerts restoring forces, which is applied from the resilient members 50, on the center hole 67 of the planetary gear 62.

The planetary gear 62 is formed in the shape of a stepped cylinder and arranged concentrically with the eccentric portion 44. That is, the planetary gear 62 is arranged eccentrically to the gear portions 14 and 22. The planetary gear 62 has a large-diameter portion and a small-diameter portion, which respectively unitarily define a driving side external gear portion 68 and a driven side external gear portion 69, each having the addendum circle located on the radially outer side of the corresponding deddendum circle. The numbers of the teeth of the driving side external gear portion 68 and the driven side external gear portion 69 are respectively set smaller than the numbers of the teeth of the driving side internal gear portion 14 and the driven side internal gear portion 22. The number of the teeth of the driven side external gear portion 69 is smaller than the number of the teeth of the driving side external gear portion 68.

The driving side external gear portion 68 is meshed with the driving side internal gear portion 14 on the inner peripheral side of this gear portion 14. The driven side external gear portion 69 is arranged in a manner to be coaxial with the driving side external gear portion 68 and to be shifted in the axial direction thereof and the driven side external gear portion 69 is meshed with the driven side internal gear portion 22 on the inner peripheral side of this gear portion 22. Thus, the planetary gear 62 can perform a planetary motion to revolve in the rotating direction of the eccentric portion 44 while revolving on the eccentricity axis E (refer to FIGS. 2 and 3) of the gear portions 68 and 69.

The phase control mechanism 8 of the configuration explained above controls the engine phase in accordance with the control torque, which is inputted from the rotary shaft 7 to the input portion 41 of the planetary carrier 40, thereby to perform the valve timing suited to the internal combustion engine.

Concretely, when the planetary carrier 40 does not rotate relatively to the driving side rotary member 10 when the control torque is held, the gear portions 68 and 69 of the planetary gear 62 rotate unitarily with the rotary members 10 and 20 while holding the meshed positions thereof with the gear portions 14 and 22, respectively. Accordingly, the engine phase does not change, and consequently the valve timing is held constant.

When the planetary carrier 40 rotates in the direction X relatively to the driving side rotary member 10 in response to increase in control torque in the direction X, the gear portions 68 and 69 of the planetary gear 62 unitarily perform the planetary motion while changing the meshed positions with the gear portions 14 and 22, respectively. Thus, the driven side rotary member 20 rotates in the direction X relatively to the driving side rotary member 10. Accordingly, the engine phase changes to an advance side, with the result that the valve timing advances.

When the planetary carrier 40 rotates in the direction Y relatively to the driving side rotary member 10 in response to increase in control torque in the direction Y, the gear portions 68 and 69 of the planetary gear 62 unitarily perform the planetary motion while changing their meshed positions with the gear portions 14 and 22, respectively. Thus, the driven side rotary member 20 rotates in the direction Y relatively to the driving side rotary member 10. Accordingly, the engine phase changes onto a retardation side, with the result that the valve timing retards.

Next, the structure of the valve timing control apparatus 1 according to the first embodiment will be explained in detail with reference to FIGS. 4 to 8.

Figure 4:
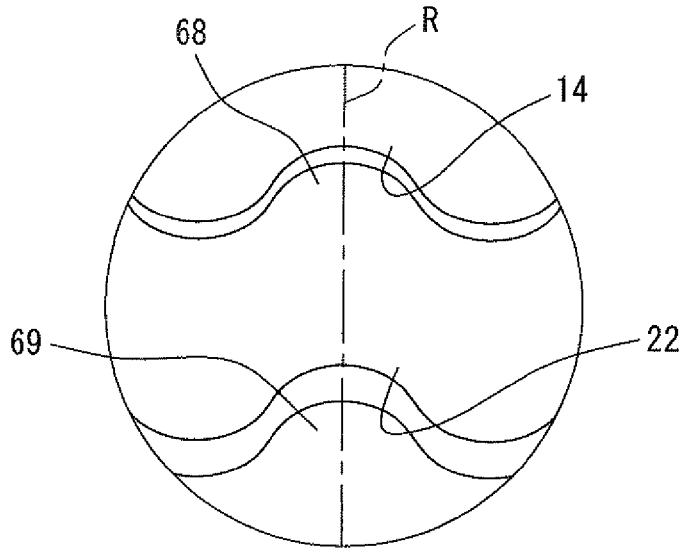
FIG. 4 is a schematic view showing a structure of components of the valve timing control apparatus according to the first and third embodiments.

FIG. 4 shows the individual gear portions 14, 22, 68, and 69 in a condition where the resilient members 50 are detached. As shown in. FIG. 4, in the present embodiment, a backlash at the meshed portion between the gear portions 22 and 69 is larger than a backlash at the meshed portion between the gear portions 14 and 68. In addition, as shown in FIGS. 4, 5, the meshed portion between the gear portions 14 and 68 and the meshed portion between the gear portions 22 and 69 are located on the eccentric center side of the gear portions 68 and 69 with respect to the gear portions 14 and 22.

That is, the gear portions 68 and 69 are eccentric with respect to the gear portions 14 and 22, and the gear portions 68 and 69 have an eccentricity axis E. The meshed portion between the gear portions 14 and 68, the meshed portion between the gear portions 22 and 69, and the eccentricity axis E are offset in the same direction from the rotation center of the gear portion 14 of the driven side rotary member 20 and the gear portion 22 of the driving side rotary member 10.

Here, in FIGS, 4, 5, 7, 8, the driven side internal gear portion 22 of the driven side rotary member 20 and the driving side external gear portion 68 of the planetary gear 62 are schematically shown as a unitary element for convenience of explanation.

Figure 5:
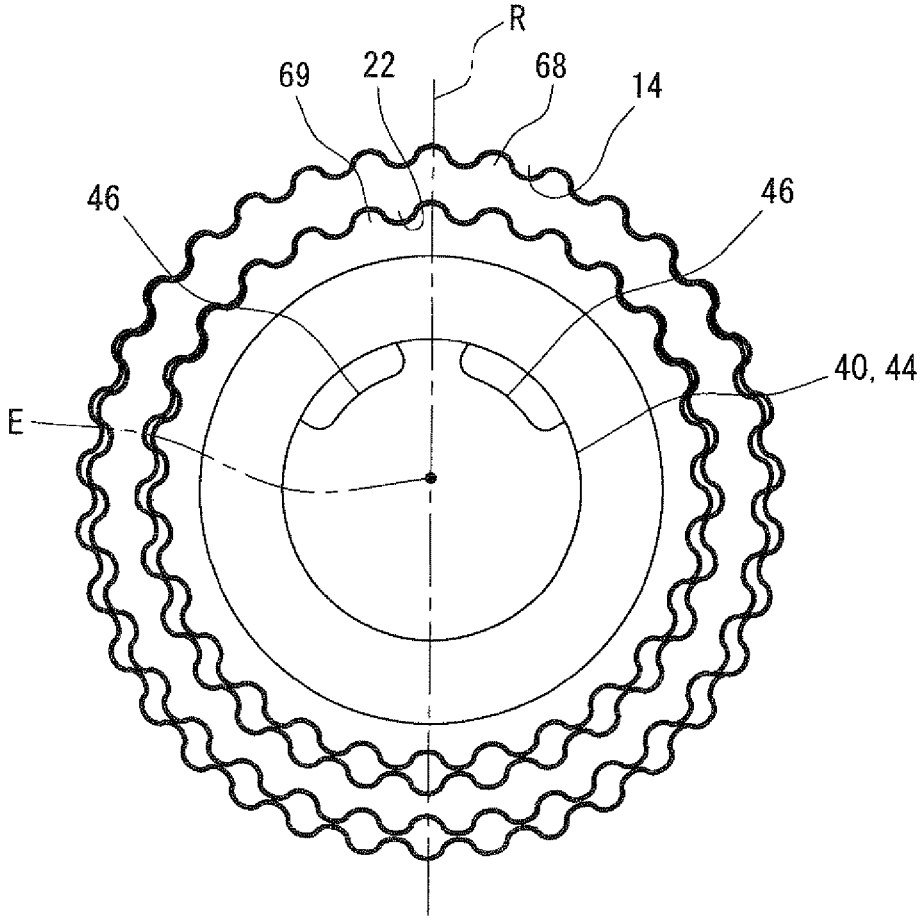
FIG. 5 is a schematic view showing a structure of components of the valve timing control apparatus according to the first embodiment.

In the eccentric portion 44 of the planetary carrier 40 shown in FIG. 5, the recesses 46 are arranged deviating to the meshed sides between the gear portions 14 and 22 and the gear portions 68 and 69, with respect to the eccentricity axis E. In particular, the recesses 46 in the present embodiment are arranged in line symmetry to a radial line R. Here, the radial line R is an imaginary straight line which extends along the eccentricity direction of the gear portions 68 and 69 with respect to the gear portions 14 and 22. The gear portions 68 and 69 are eccentric with respect to the gear portions 14 and 22 in the eccentricity direction.

As shown in FIGS. 1, 2, each of the resilient members 50 is formed of a metallic leaf spring, which has a substantially U-shaped section. Each of the resilient members 50 is accommodated in the corresponding recess 46. The U-shaped resilient member 50 has both the end portions 52 and 53 opposed to each other in the radial direction of the planetary rotary member 60. Both the end portions 52 and 53 define the opening therebetween and the opening faces in the circumferential direction of the planetary rotary member 60. The side of one end portion 52 of each of the resilient members 50 is in contact with the inner bottom surface of the corresponding recess 46. Here, a small clearance is formed at the fitting interface between the eccentric portion 44 of the planetary carrier 40 and the inner ring 65 of the planetary bearing 61 of the planetary rotary member 60. The side of the other end portion 53 of each of the resilient members 50 protrudes from the recess 46 into the clearance at the fitting interface and is in contact with the inner peripheral surface of the inner ring 65 of the planetary bearing 61.

In the above structure, each of the resilient members 50 is interposed between the eccentric portion 44 of the planetary carrier 40 and the planetary bearing 61 of the planetary rotary member 60. In such an interposed state, each of the resilient members 50 is compressed and resiliently deformed in the radial direction of the planetary rotary member 60, thereby exerting a restoring force on the planetary rotary member 60, which is located radially outward. In addition, in the present embodiment, the recesses 46 are arranged as stated above for accommodating the resilient members 50. Therefore, a resultant force of the restoring forces of the resilient members 50 acts on the planetary rotary member 60 toward the eccentric center of the gear portions 68 and 69 relative to the gear portions 14 and 22.

In addition, as shown in FIG. 1, the contact portions between the planetary bearing 61 of the planetary rotary member 60 and the end portions 53 of the resilient members 50 are located on the radially inner side of the meshed portion between the gear portions 22 and 69. The center positions C1 of the contact portions between the planetary bearing 61 and the resilient members 50 with respect to the axial direction of the planetary rotary member 60 are set within a range G1 (refer to FIG. 1), without being shifted from each other in the axial direction of the planetary rotary member 60. The contact portions are located on the radially inner side of the meshed portion between the gear portions 22 and 69.

Figure 6:
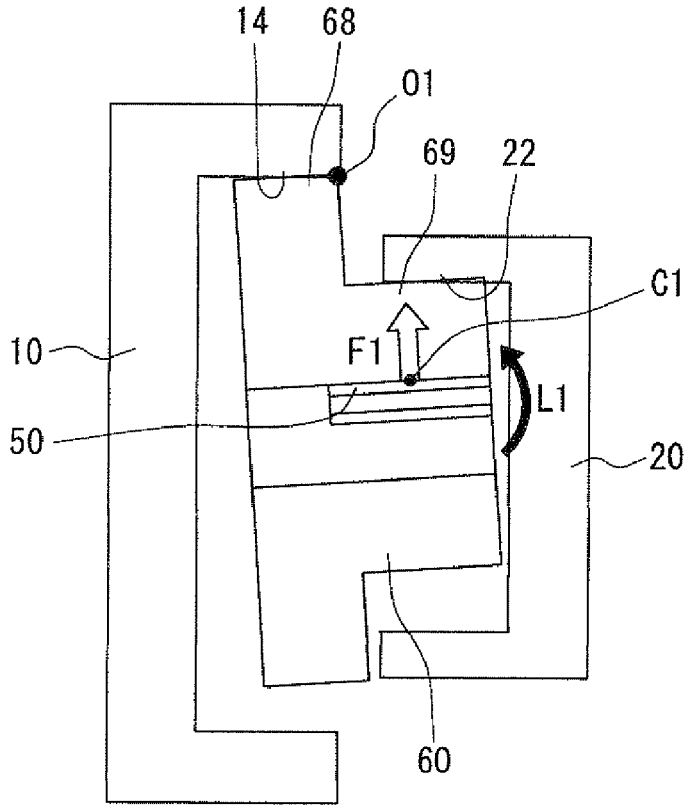
FIG. 6 is a schematic view showing a structure of components of the valve timing control apparatus according to the first embodiment.
Figure 7:
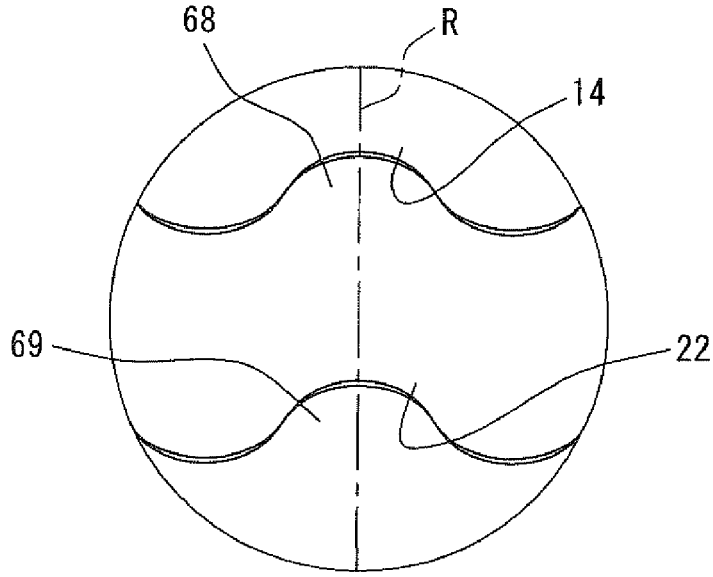
FIG. 7 is a schematic view showing a structure of components of the valve timing control apparatus according to the first to fourth embodiments.

In the present structure according to the first embodiment, as shown in FIG. 6, the resultant force F1 of the restoring forces of the resilient members 50 acts as a radially outward force on the planetary rotary member 60. The radially outward force is exerted to the center position C1 as the point of action, In addition, as shown in FIG. 6, the planetary rotary member 60 is urged radially outward by the action of the resultant force F1. Thus, the planetary rotary member 60 is inclined around a fulcrum O1, which corresponds to the meshed portion between the gear portions 14 and 68, toward L1, which corresponds to the meshed portion between the gear portions 22 and 69. The backlash at the meshed portion between the gear portions 14 and 68 is smaller than the backlash at the meshed portion between the gear portions 22 and 69. As a result, as shown in FIG. 7, the gear portions 14 and 68 on the side of the fulcrum O1 are regularly in contact with each other, to reduce the backlash, and also the gear portions 22 and 69 on the inclination side are regularly in contact with each other, to reliably reduce the backlash. Accordingly, abnormal sound or damage caused by collision between the gear portions 14 and 68 or the gear portions 22 and 69 can be reduced.

The resilient members 50 protrude from the recesses 46 and is in contact with the planetary rotary member 60 under a state where being accommodated in these recesses 46, thereby to be positioned. Thus, the restoring forces can be reliably exerted on the planetary rotary member 60 to effectively reduce the backlashes while steadily holding the resilient members 50 between the planetary carrier 40 and the planetary rotary member 60, which rotate relatively to each other. Moreover in the planetary rotary member 60, the restoring forces of the resilient members 50 act on the planetary gear 62 via the planetary bearing 61, so that the backlashes can be effectively reduced while smoothening the revolution of the planetary gear 62 on the axis.

In the present first embodiment, the driving side rotary member 10 may correspond to a first rotary member, and the driven side rotary member 20 may correspond to a second rotary member. In addition, the driving side internal gear portion 14 may correspond to a first gear portion, the driven side internal gear portion 22 may correspond to a second gear portion, the driving side external gear portion 68 may correspond a third gear portion, and the driven side external gear portion 69 may correspond to a fourth gear portion.

Second Embodiment

Figure 8:
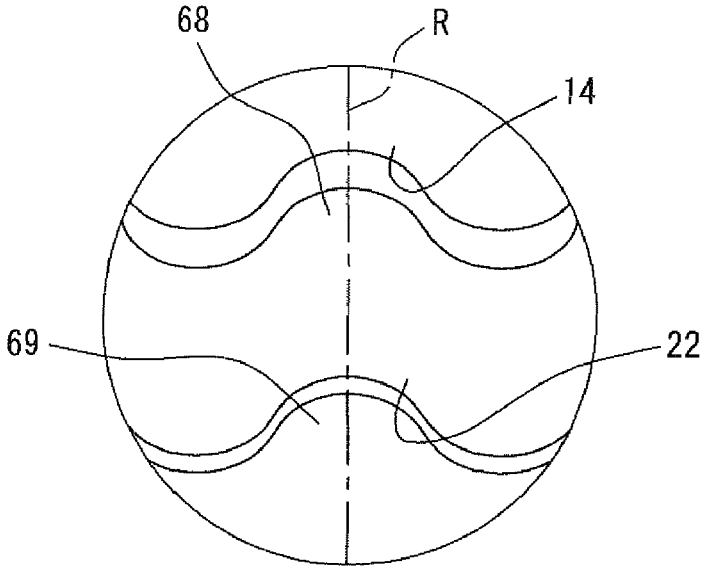
FIG. 8 is a schematic view showing a structure of components of the valve timing control apparatus according to second and the fourth embodiments.
Figure 10:
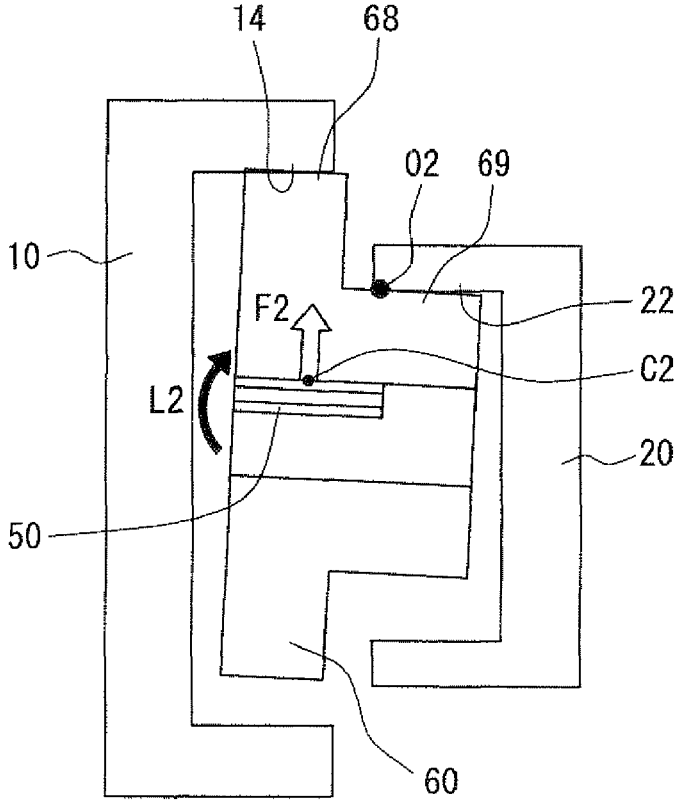
FIG. 10 is a schematic view showing a structure of components of the valve timing control apparatus according to the second embodiment.
Figure 9:
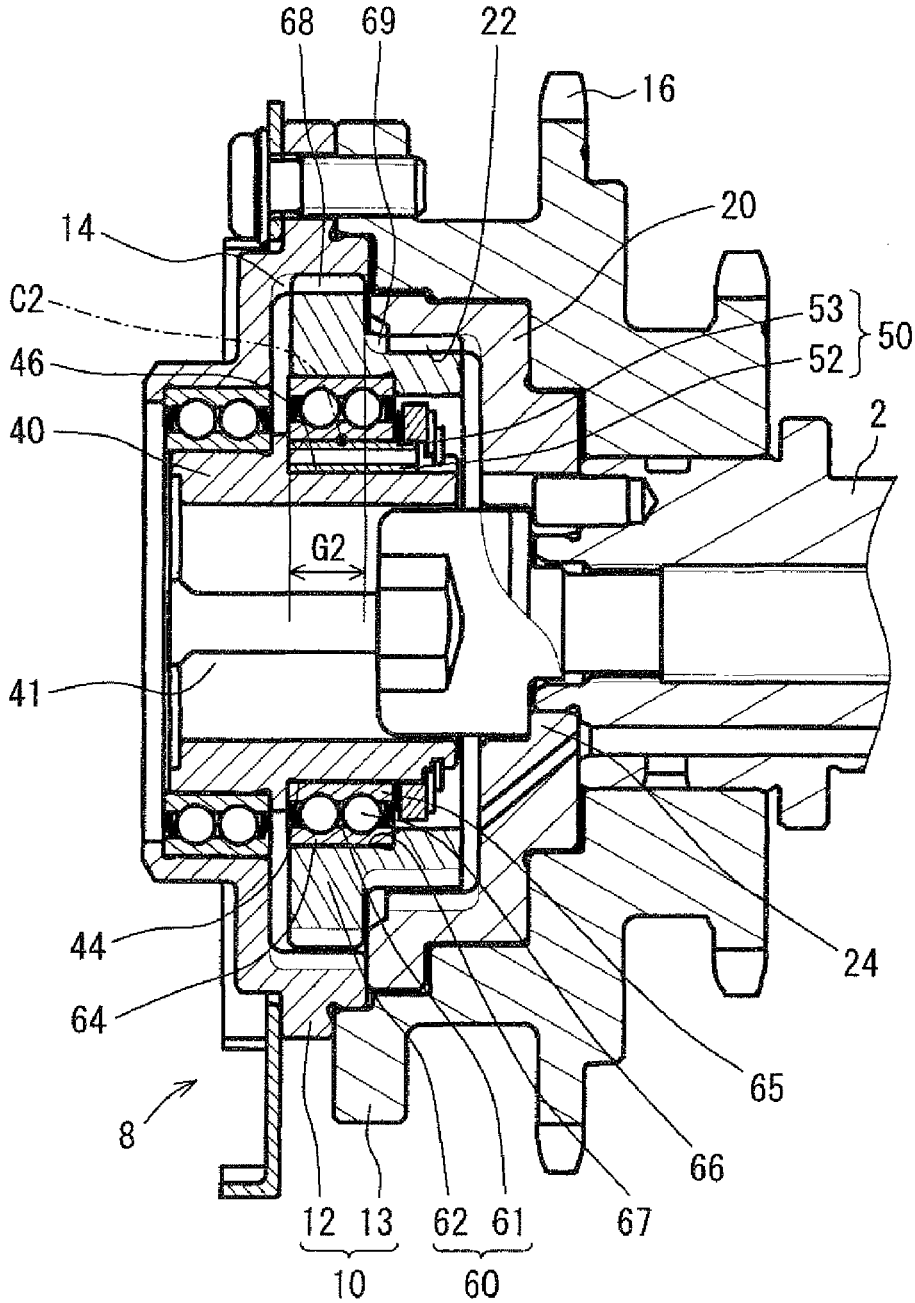
FIG. 9 is a sectional view showing a valve timing control apparatus according to the second embodiment.

As shown in FIGS. 8 to 10, the second embodiment is a modification of the first embodiment. FIG. 8 shows the gear portions 14, 22, 68, and 69 in a condition where the resilient members 50 are detached. As shown in FIGS. 8 to 10, in the second embodiment, the backlash at the meshed portion between the gear portions 14 and 68 is larger than the backlash at the meshed portion between the gear portions 22 and 69.

As shown in FIG. 9, the contact portions between the planetary bearing 61 of the planetary rotary member 60 and the end portions 53 of the resilient members 50 are located on the radially inner side of the meshed portion between the gear portions 14 and 68. Thus, the center positions C2 of the contact portions between the planetary bearing 61 and the resilient members 50 with respect to the axial direction of the planetary rotary member 60 are set within a range G2 (refer to FIG. 9), without being shifted from each other with respect to the axial direction. The contact portions are located on the radially inner side of the meshed portion between the gear portions 14 and 68.

In the present second embodiment, as shown in FIG. 10, the resultant force F2 of the restoring forces of the resilient members 50 acts as a radially outward force on the planetary rotary member 60 at the center position C2 as the point of action. In addition, as shown in FIG. 10, the planetary rotary member 60 is urged radially outward by the action of the resultant force F2. Thus, the planetary rotary member 60 is inclined around a fulcrum O2, which corresponds to the meshed portion between the gear portions 22 and 69, toward L2, which corresponds to the meshed portion between the gear portions 14 and 68. The backlash at the meshed portion between the gear portions 22 and 69 is smaller than the backlash at the meshed portion between the gear portions 14 and 68. As a result, as shown in FIG. 7, the gear portions 22 and 69 on the side of the fulcrum 02 are regularly in contact with each other, thereby reducing the backlash therebetween, and the gear portions 14 and 68 on the inclination side are also regularly in contact with each other, thereby reliably reducing the backlash therebetween. Accordingly, an abnormal sound or damage can be reduced also in the second embodiment.

Third Embodiment

Figure 11:
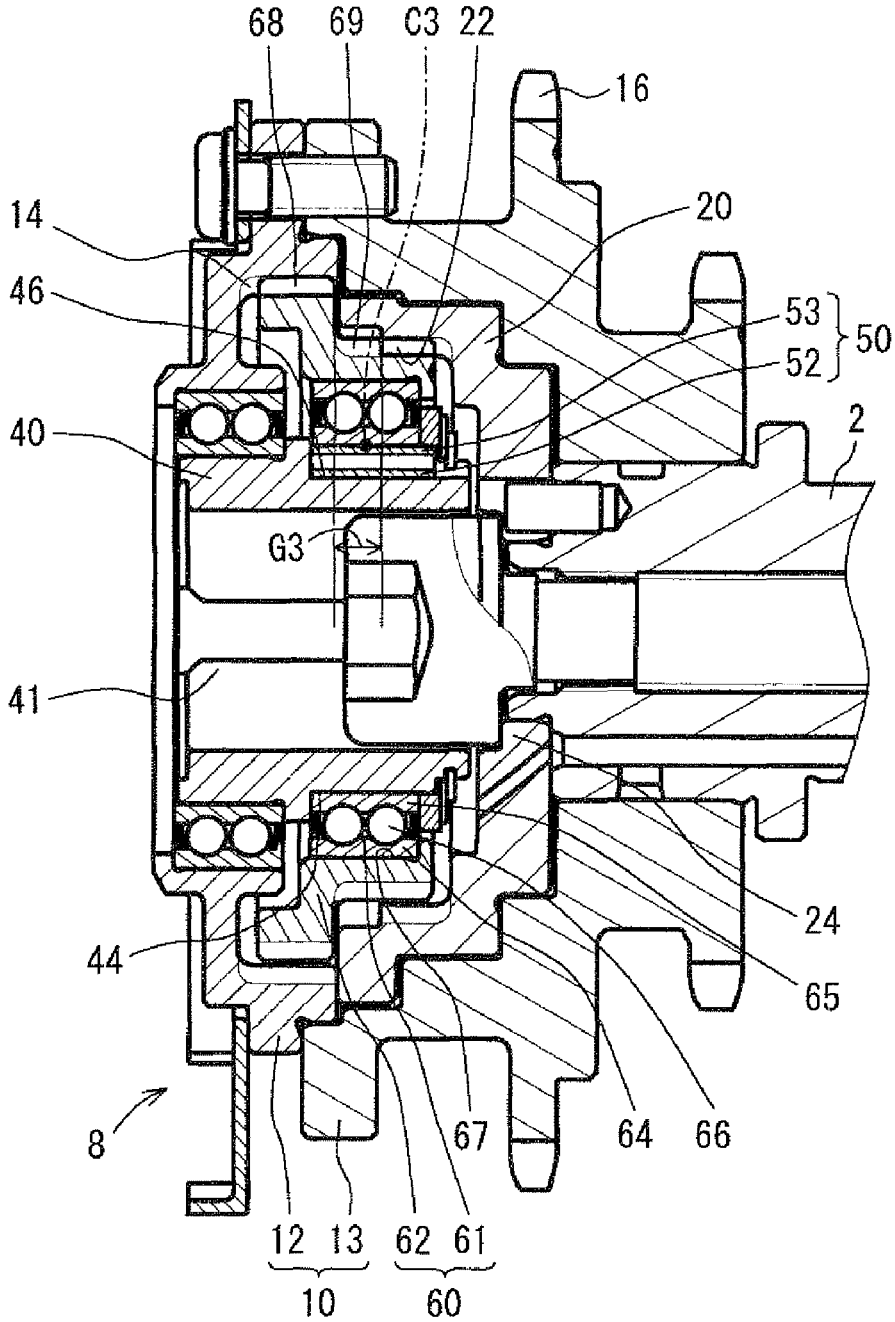
FIG. 11 is a sectional view showing a valve timing control apparatus according to the third and fourth embodiments.
Figure 12:
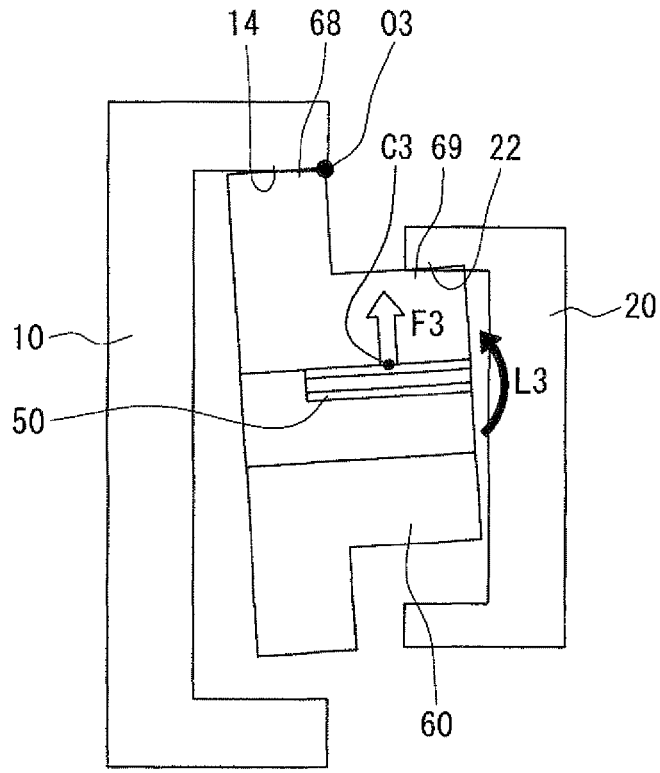
FIG. 12 is a schematic view showing a structure of components of the valve timing control apparatus according to the third embodiment.

As shown in FIGS. 11 to 12, the third embodiment is a modification of the first embodiment. As shown in FIG. 11, the contact portions between the planetary bearing 61 of the planetary rotary member 60 and the end portions 53 of the resilient members 50 are located on the radially inner side of the end portion of the gear portion 69, the end portion of the gear portion 69 being located on the side of the gear portion 68. The center positions C3 of the contact portions between the planetary bearing 61 and the resilient members 50 with respect to the axial direction of the planetary rotary member 60, are set within a range G3 (refer to FIG. 11), without being shifted from each other with respect to the axial direction. The center positions C3 is located between the meshed portion between the gear portions 14 and 68 and the meshed portion between the gear portions 22 and 69. In the third embodiment, the backlash at the meshed portion between the gear portions 22 and 69 is larger than the backlash at the meshed portion between the gear portions 14 and 68, similarly to the first embodiment shown in FIG. 4.

In the present third embodiment, as shown in FIG. 12, the resultant force F3 as a radially outward force of the restoring forces of the resilient members 50 acts on the planetary rotary member 60 at the center position C3 as the point of action. In addition, as shown in FIG. 12, the planetary rotary member 60 is urged radially outward by the action of such a resultant force F3. The planetary rotary member 60 is inclined around a fulcrum O3, which corresponds to the meshed portion between the gear portions 14 and 68, to the L3, which corresponds to the meshed portion between the gear portions 22 and 69. The backlash at the meshed portion between the gear portions 14 and 68 is smaller than the backlash at the meshed portion between the gear portions 22 and 69. As a result, as shown in FIG. 7, the gear portions 14 and 68 on the side of the fulcrum 03 are regularly in contact with each other to reduce the backlash, and the gear portions 22 and 69 on the inclination side are also regularly in contact with each other, thereby reliably reducing the backlash. Accordingly, an abnormal sound or damage can be reduced also by the third embodiment.

Fourth Embodiment

The fourth embodiment is a modification produced by combining the second embodiment shown in FIG. 8 and the third embodiment shown in FIG. 11. FIG. 8 shows the gear portions 14, 22, 68, and 69 in a condition where the resilient members 50 are detached. According to the present fourth embodiment, the backlash at the meshed portion between the gear portions 14 and 68 is larger than the backlash at the meshed portion between the gear portions 22 and 69 in a condition where the resilient members 50 are detached. In addition, as shown in FIG. 11, according to the fourth embodiment, the center positions C3 of the contact portions between the planetary bearing 61 and the resilient members 50 are set between the meshed portion between the gear portions 14 and 68 and the meshed portion between the gear portions 22 and 69 with respect to the axial direction of the planetary rotary member 60.

Figure 13:
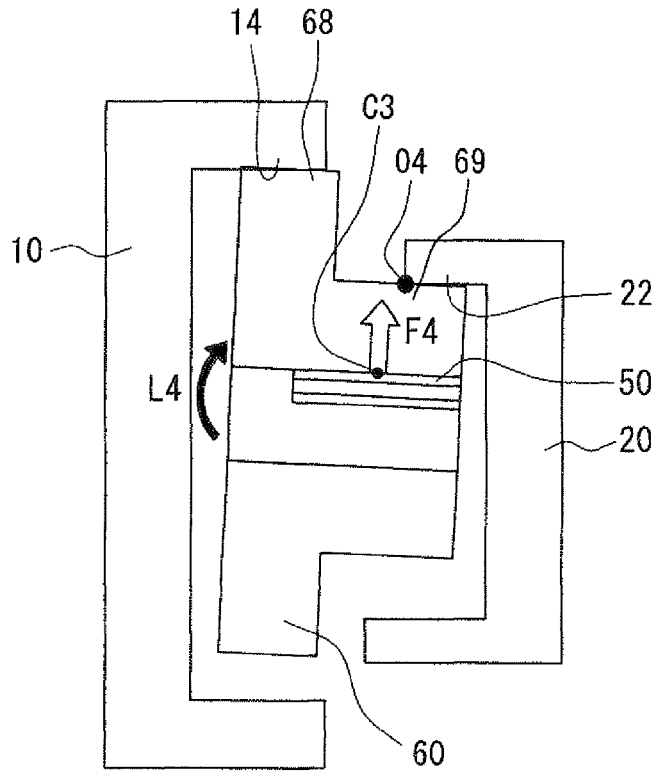
FIG. 13 is a schematic view showing a structure of components of the valve timing control apparatus according to the fourth embodiment.

In the present fourth embodiment, as shown in FIG. 13, the resultant force F4 as a radially outward force of the restoring forces of the resilient members 50 acts on the planetary rotary member 60 at the center position C3 as the point of action. In addition, as shown in FIG. 13, the planetary rotary member 60 is urged radially outward by the action of such a resultant force F4. Therefore, the planetary rotary member 60 is inclined around a fulcrum O4, which corresponds to the meshed portion between the gear portions 22 and 69, to the L4, which corresponds to the meshed portion between the gear portions 14 and 68. The backlash at the meshed portion between the gear portions 14 and 68 is larger than the backlash at the meshed portion between the gear portions 22 and 69. As a result, as shown in FIG. 7, the gear portions 22 and 69 on the side of the fulcrum O4 are regularly in contact with each other to reduce the backlash, and the gear portions 14 and 68 on the inclination side are also regularly in contact with each other to reliably reduce the backlash. Accordingly, an abnormal sound or damage can be reduced also by the fourth embodiment.

Fifth Embodiment

Figure 14:
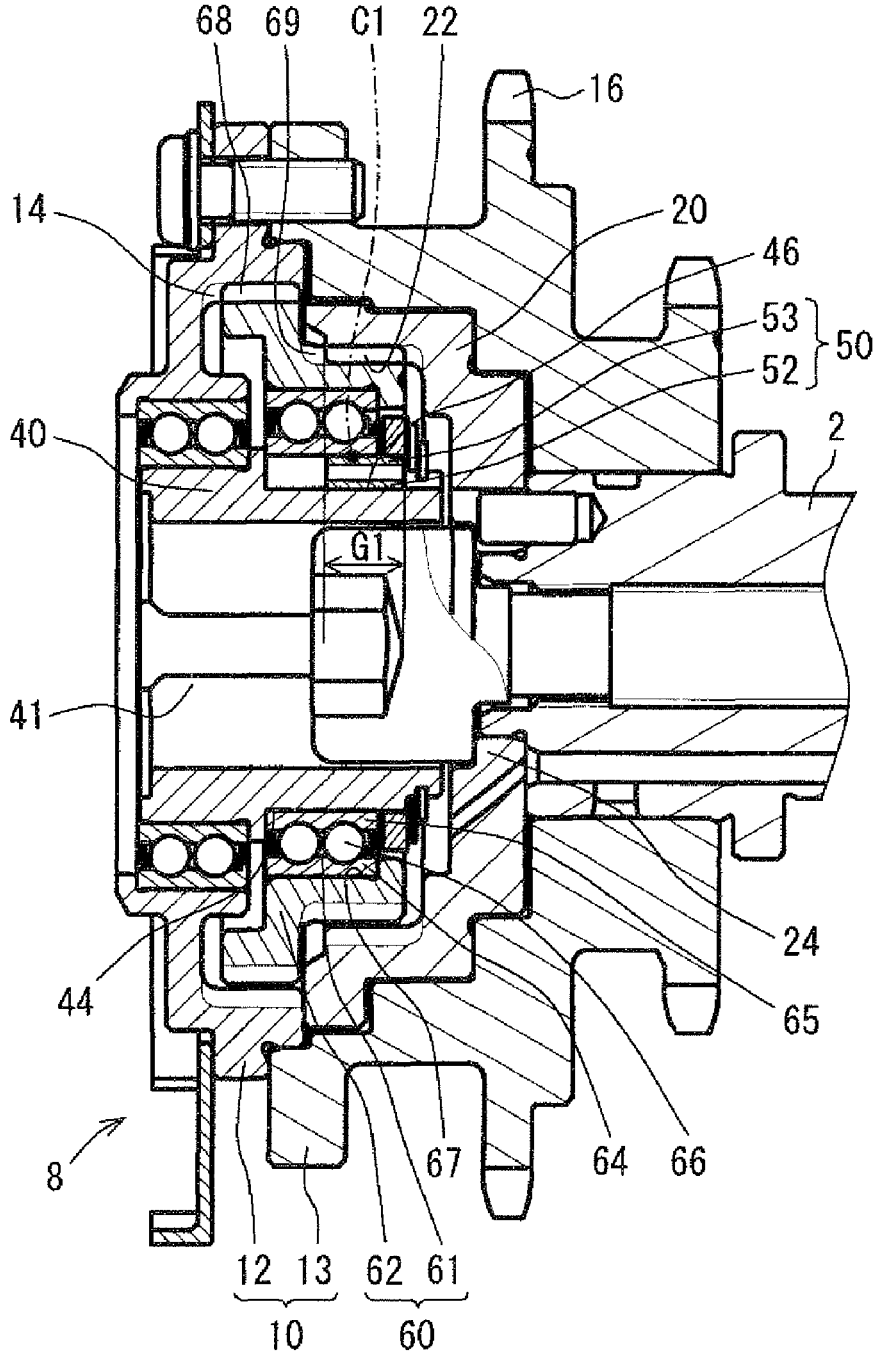
FIG. 14 is a sectional view showing a valve timing control apparatus according to a fifth embodiment.

As shown in FIG. 14, the fifth embodiment is a modification of the first embodiment. As shown in FIG. 14, the contact portions between the planetary bearing 61 of the planetary rotary member 60 and the end portions 53 of the resilient members 50 are located on the radially inner side of the meshed portion between the gear portions 22 and 69. In addition, the contact portions are located so as to be steadily away from the radially inner side of the meshed portion between gear portions 14 and 68. Thus, the center positions C1 of the contact portions between the planetary bearing 61 and the resilient members 50 are accurately set within a range G1 (refer to FIG. 14) with respect to the axial direction of the planetary rotary member 60. That is, the center positions C1 is located on the radially inner side of the meshed portion between the gear portions 22 and 69 without being shifted from each other with respect to the axial direction. Accordingly, an abnormal sound or damage can be reduced in accordance with the same principle as in the first embodiment.

Sixth Embodiment

Figure 15:
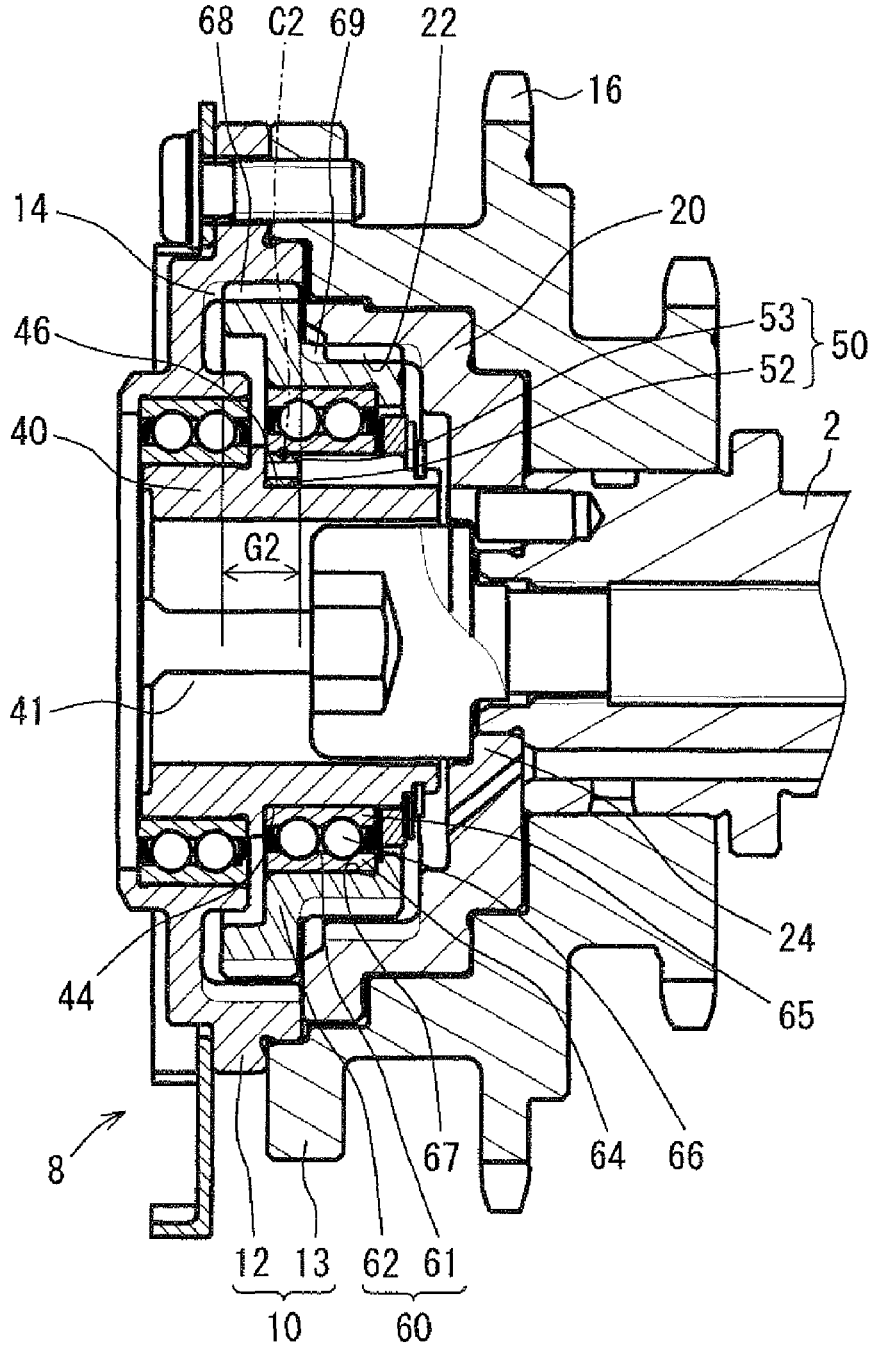
FIG. 15 is a sectional view showing a valve timing control apparatus according to a sixth embodiment.

As shown in FIG. 15, the sixth embodiment is a modification of the second embodiment. As shown in FIG. 15, the contact portions between the planetary bearing 61 of the planetary rotary member 60 and the end portions 53 of the resilient members 50 are located on the radially inner side of the meshed portion between gear portions 14 and 68. In addition, the contact portions are located so as to be reliably away from the radially inner side of the meshed portion between gear portions 22 and 69. Thus, the center positions C2 of the contact portions between the planetary bearing 61 and the resilient members 50 are accurately set within a range G2 (refer to FIG. 15) with respect to the axial direction of the planetary rotary member 60. In addition, the center positions C2 are located on the radially inner side of the meshed portion between the gear portions 14 and 68 without being shifted from each other with respect to the axial direction. Accordingly, an abnormal sound or damage can be reduced in accordance with the same principle as in the second embodiment.

Seventh Embodiment

Figure 16:
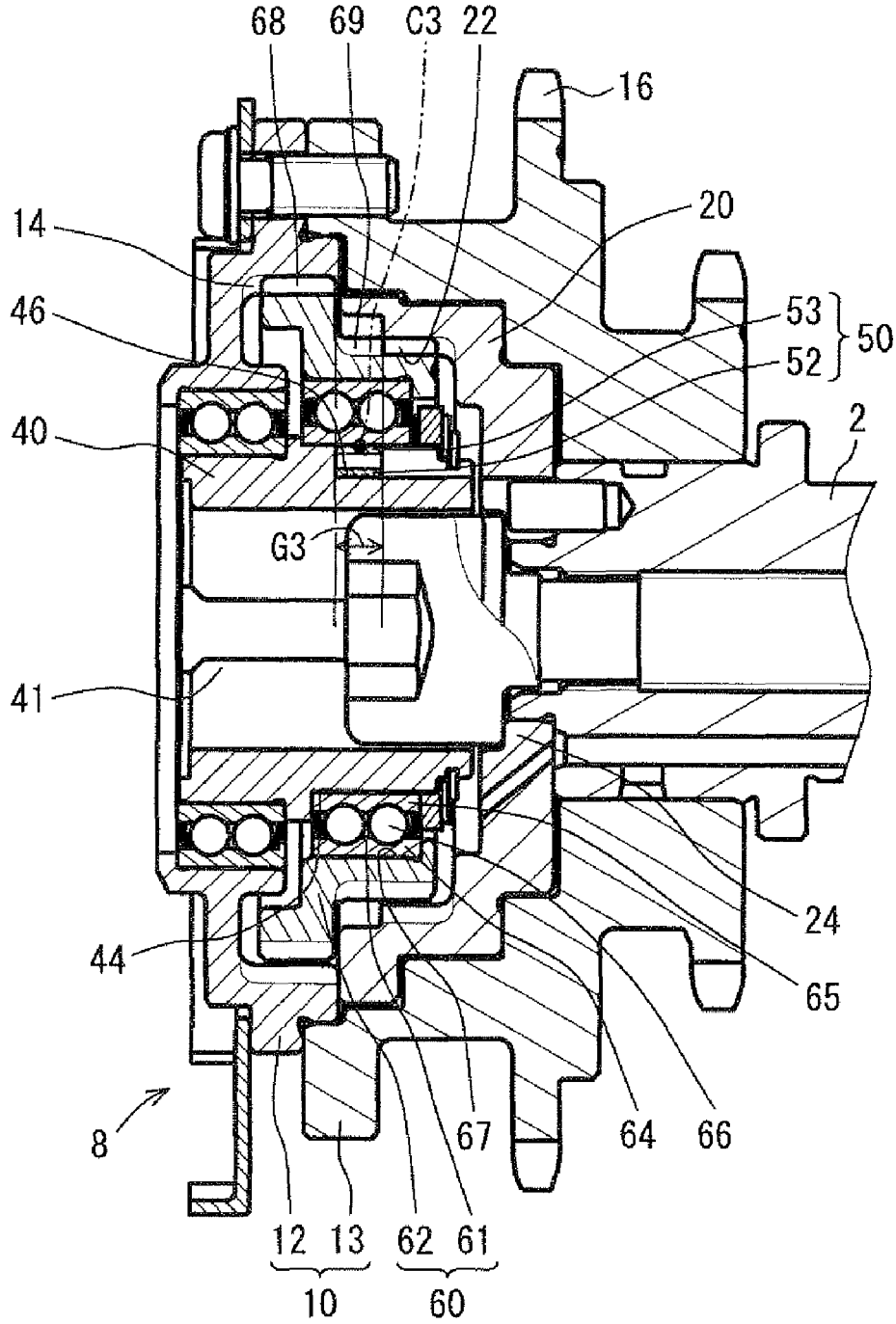
FIG. 16 is a schematic view showing a structure of components of the valve timing control apparatus according to the second embodiment.

As shown in FIG. 16, the seventh embodiment is a modification of the third embodiment. As shown in FIG. 16, the contact portions between the planetary bearing 61 of the planetary rotary member 60 and the end portions 53 of the resilient members 50 are located on the radially inner side of the end portion of the gear portion 69, the end portion of the gear portion 69 being located on the side of a gear portion 68. In the present structure, the contact portions are reliably away from both the radially inner side of the meshed portion between gear portions 14 and 68 and the radially inner side of the meshed portion between gear portions 22 and 69. Thus, the center positions C3 of the contact portions between the planetary bearing 61 and the resilient members 50 are accurately set within a range G3 (refer to FIG. 16) with respect to the axial direction of the planetary rotary member 60. Therefore, the center positions C3 is located between the meshed portion between the gear portions 14 and 68 and the meshed portion between the gear portions 22 and 69 without being shifted from each other with respect to the axial direction. Accordingly, an abnormal sound or damage can be reduced in accordance with the same principle as in the third embodiment. In the present seventh embodiment, the feature of the fourth embodiment described above may well be performed.

Other Embodiments

By way of example, in each of the first to seventh embodiments, each of the resilient members 50 may well be a leaf spring other than the leaf spring having the U-shaped section, a coil spring, a torsion spring or an elastic member such as a rubber member. In addition, in each of the first to seventh embodiments, at least one resilient member 50 may be provided, and the number of such resilient members to be provided can be appropriately set in accordance with specifications, or the like. Here, in a case, for example, where only one resilient member 50 is provided, the resilient member 50 may be arranged on the radial line R so as to exert the restoring force on the planetary rotary member 60 toward the eccentric center of the gear portions 68 and 69 relative to the gear portions 14 and 22. Alternatively, in this case, the resilient member 50 may well be arranged in a place shifted from the radial line R with respect to the circumferential direction of the planetary rotary member 60, so as to exert the restoring force on the planetary rotary member 60 in the place. On the other hand, in a case where multiple resilient members 50 are provided, the resultant force of the restoring forces of the resilient members 50 may desirably be exerted on the planetary rotary member 60 toward the eccentric center of the gear portions 68 and 69 relative to the gear portions 14 and 22.

In each of the first to seventh embodiments, the planetary rotary member 60 may well be configured only of the planetary gear 62, so as to exert the restoring force of the resilient member 50 directly on the inner periphery of the center hole 67 of the planetary gear 62. In addition, in each of the first to seventh embodiments, at least one of the external gear portions 68 and 69 and at least one of the internal gear portions 14 and 22 may well be altered respectively to an internal gear portion and an external gear portion.

In each of the first to seventh embodiments, the rotary member 10 may be rotated in conjunction with the camshaft 2, and the rotary member 20 may be rotated in conjunction with the crankshaft. In this case, the relationship among elements corresponding to the first rotary member and second rotary member, elements corresponding to the first gear portion and second gear portion and elements corresponding to the third gear portion and fourth gear portion may become reverse to the relationship explained in the first embodiment. In addition, in each of the first to seventh embodiments, any devices other than the electric motor 5, for example, an electric brake or a hydraulic motor, may well be employed as the device for generating the control torque, which is transmitted to the phase control mechanism 8.

In addition, the above structures may be applied, not only to the apparatus for controlling the valve timing of the intake valve, as in each of the first to seventh embodiments, but also to an apparatus for controlling the valve timing of an exhaust valve, and an apparatus for controlling the valve timings of both the intake valve and the exhaust valve.

The above structures of the embodiments can be arbitrary combined. Various modifications and alternations may be diversely made to the above embodiments without departing from the spirit of the present invention.

What is claimed is:

1. A valve timing control apparatus configured to be transmitted with torque from a crankshaft and controlling a camshaft to manipulate a valve timing of at least one of an intake valve and an exhaust valve of an internal combustion engine, the valve timing control apparatus comprising:

a first rotary member configured to rotate in conjunction with the crankshaft and having a first gear portion;

a second rotary member configured to rotate in conjunction with the camshaft and having a second gear portion that is shifted from the first gear portion with respect to an axial direction;

a planetary rotary member having a third gear portion and a fourth gear portion, which are configured to be eccentrically meshed respectively with the first gear portion and the second gear portion so as to unitarily perform a planetary motion thereby to change a relative phase between the first rotary member and the second rotary member;

a planetary carrier configured to support the planetary rotary member from a radially inner side; and a biasing member interposed between the planetary rotary member and the planetary carrier to bias the planetary rotary member radially outward, wherein the first gear portion and the third gear portion therebetween define a first-third meshed portion, the second gear portion and the fourth gear portion therebetween define a second-fourth meshed portion, the second-fourth meshed portion has a backlash, which is larger than a backlash of the first-third meshed portion, the planetary rotary member is in contact with the biasing member at a contact portion having a center position with respect to the axial direction, and the center position is located on a radially inner side of the second-fourth meshed portion.

2. The valve timing control apparatus according to claim 1, wherein the contact portion is located away from a radially inner side of the first-third meshed portion.

3. The valve timing control apparatus according to claim 1, wherein the third gear portion and the fourth gear portion have an eccentricity axis, the eccentricity axis, the first-third meshed portion, and the second-fourth meshed portion are offset in the same direction from the rotation center of the first gear portion and the second gear portion, and the biasing members exerts restoring forces, which has a resultant force acting on the planetary rotary member toward the eccentric center.

4. The valve timing control apparatus according to claim 1, wherein the biasing member has a U-shaped section, which has an opening with respect to a circumferential direction of the planetary rotary member, and the U-shaped section has a pair of end portions opposed to each other with respect to a radial direction of the planetary rotary member.

5. The valve timing control apparatus according to claim 4, wherein the planetary carrier has a recess which is open radially outward to the planetary rotary member, the recess accommodates the biasing member, and one of the pair of end portions protrudes from the recess.

6. The valve timing control apparatus according to claim 1, wherein the planetary rotary member has a planetary gear and a planetary bearing, the planetary gear has the third gear portion and the fourth gear portion, the planetary bearing has an outer ring and an inner ring, the outer ring is fixed on an inner peripheral side of the planetary gear, the inner ring is fitted on an outer peripheral side of the planetary carrier, and the biasing member is interposed between the planetary carrier and the planetary bearing.

7. A valve timing control apparatus configured to be transmitted with torque from a crankshaft and controlling a camshaft to manipulate a valve timing of at least one of an intake valve and an exhaust valve of an internal combustion engine, the valve timing control apparatus comprising:

a first rotary member configured to rotate in conjunction with the crankshaft and having a first gear portion;

a second rotary member configured to rotate in conjunction with the camshaft and having a second gear portion that is shifted from the first gear portion with respect to an axial direction;

a planetary rotary member having a third gear portion and a fourth gear portion, which are configured to be eccentrically meshed respectively with the first gear portion and the second gear portion so as to unitarily perform a planetary motion thereby to change a relative phase between the first rotary member and the second rotary member;

a planetary carrier configured to support the planetary rotary member from a radially inner side; and a biasing member interposed between the planetary rotary member and the planetary carrier to bias the planetary rotary member radially outward, wherein the first gear portion and the third gear portion therebetween define a first-third meshed portion, the second gear portion and the fourth gear portion therebetween define a second-fourth meshed portion, the first-third meshed portion has a backlash, which is larger than a backlash of the second-fourth meshed portion, the planetary rotary member is in contact with the biasing member at a contact portion having a center position with respect to the axial direction, and the center position is located on a radially inner side of the first-third meshed portion.

8. The valve timing control apparatus according to claim 7, wherein the contact portion is located away from a radially inner side of the second-fourth meshed portion.

9. The valve timing control apparatus according to claim 7, wherein the third gear portion and the fourth gear portion have an eccentricity axis, the eccentricity axis, the first-third meshed portion, and the second-fourth meshed portion are offset in the same direction from the rotation center of the first gear portion and the second gear portion, and the biasing members exerts restoring forces, which has a resultant force acting on the planetary rotary member toward the eccentric center.

10. The valve timing control apparatus according to claim 7, wherein the biasing member has a U-shaped section, which has an opening with respect to a circumferential direction of the planetary rotary member, and the U-shaped section has a pair of end portions opposed to each other with respect to a radial direction of the planetary rotary member.

11. The valve timing control apparatus according to claim 10, wherein the planetary carrier has a recess which is open radially outward to the planetary rotary member, the recess accommodates the biasing member, and one of the pair of end portions protrudes from the recess.

12. The valve timing control apparatus according to claim 7, wherein the planetary rotary member has a planetary gear and a planetary bearing, the planetary gear has the third gear portion and the fourth gear portion, the planetary bearing has an outer ring and an inner ring, the outer ring is fixed on an inner peripheral side of the planetary gear, the inner ring is fitted on an outer peripheral side of the planetary carrier, and the biasing member is interposed between the planetary carrier and the planetary bearing.

13. A valve timing control apparatus configured to be transmitted with torque from a crankshaft and controlling a camshaft to manipulate a valve timing of at least one of an intake valve and an exhaust valve of an internal combustion engine, the valve timing control apparatus comprising:

a first rotary member configured to rotate in conjunction with the crankshaft and having a first gear portion;

a second rotary member configured to rotate in conjunction with the camshaft and having a second gear portion that is shifted from the first gear portion with respect to an axial direction;

a planetary rotary member having a third gear portion and a fourth gear portion, which are configured to be eccentrically meshed respectively with the first gear portion and the second gear portion so as to unitarily perform a planetary motion thereby to change a relative phase between the first rotary member and the second rotary member;

a planetary carrier configured to support the planetary rotary member from a radially inner side; and a biasing member interposed between the planetary rotary member and the planetary carrier to bias the planetary rotary member radially outward, wherein the first gear portion and the third gear portion therebetween define a first-third meshed portion, the second gear portion and the fourth gear portion therebetween define a second-fourth meshed portion, the planetary rotary member is in contact with the biasing member at a contact portion having a center position with respect to the axial direction, and the center position is located between the first-third meshed portion and the second-fourth meshed portion with respect to an axial direction of the planetary rotary member.

14. The valve timing control apparatus according to claim 13, wherein the contact portion is located away from both a radially inner side of the first-third meshed portion and a radially inner side of the second-fourth meshed portion.

15. The valve timing control apparatus according to claim 13, wherein the first-third meshed portion has a backlash, which is smaller than a backlash of the second-fourth meshed portion.

16. The valve timing control apparatus according to claim 13, wherein the second-fourth meshed portion has a backlash, which is smaller than a backlash of the first-third meshed portion.

17. The valve timing control apparatus according to claim 13, wherein the third gear portion and the fourth gear portion have an eccentricity axis, the eccentricity axis, the first-third meshed portion, and the second-fourth meshed portion are offset in the same direction from the rotation center of the first gear portion and the second gear portion, and the biasing members exerts restoring forces, which has a resultant force acting on the planetary rotary member toward the eccentric center.

18. The valve timing control apparatus according to claim 13, wherein the biasing member has a U-shaped section, which has an opening with respect to a circumferential direction of the planetary rotary member, and the U-shaped section has a pair of end portions opposed to each other with respect to a radial direction of the planetary rotary member.

19. The valve timing control apparatus according to claim 18, wherein the planetary carrier has a recess which is open radially outward to the planetary rotary member, the recess accommodates the biasing member, and one of the pair of end portions protrudes from the recess.

20. The valve timing control apparatus according to claim 13, wherein the planetary rotary member has a planetary gear and a planetary bearing, the planetary gear has the third gear portion and the fourth gear portion, the planetary bearing has an outer ring and an inner ring, the outer ring is fixed on an inner peripheral side of the planetary gear, the inner ring is fitted on an outer peripheral side of the planetary carrier, and the biasing member is interposed between the planetary carrier and the planetary bearing.

21. A valve timing control apparatus configured to be transmitted with torque from a crankshaft and controlling a camshaft to manipulate a valve timing of at least one of an intake valve and an exhaust valve of an internal combustion engine, the valve timing control apparatus comprising:

a first rotary member configured to rotate in conjunction with the crankshaft and having a first gear portion;

a second rotary member configured to rotate in conjunction with the camshaft and having a second gear portion that is shifted from the first gear portion with respect to an axial direction;

a planetary rotary member having a third gear portion and a fourth gear portion, which are configured to be eccentrically meshed respectively with the first gear portion and the second gear portion so as to unitarily perform a planetary motion thereby to change a relative phase between the first rotary member and the second rotary member;

a planetary carrier configured to support the planetary rotary member from a radially inner side; and a biasing member interposed between the planetary rotary member and the planetary carrier to bias the planetary rotary member radially outward, wherein the first gear portion and the third gear portion therebetween define a first-third meshed portion, the second gear portion and the fourth gear portion therebetween define a second-fourth meshed portion, the planetary rotary member is in contact with the biasing member at a contact portion having a center position with respect to an axial direction, and the center position is located on a radially inner side of one of the first-third meshed portion and the second gear portion, which has a backlash larger than a backlash of an other of the first-third meshed portion and the second gear portion.

* * * * *